US005253509A

United States Patent [19]

Venäläinen

[11] Patent Number: 5,253,509

[45] Date of Patent: Oct. 19, 1993

[54] STRAIGHTENING DEVICE FOR A CAR BODY

[75] Inventor: Olavi Venäläinen, Kuopio, Finland

[73] Assignee: Autorobot Finland KY, Finland

[21] Appl. No.: 855,708

[22] PCT Filed: Aug. 26, 1991

[86] PCT No.: PCT/FI91/00262

§ 371 Date: May 5, 1992

§ 102(e) Date: May 5, 1992

[87] PCT Pub. No.: WO92/04140

PCT Pub. Date: Apr. 19, 1992

[30] Foreign Application Priority Data

Sep. 10, 1990 [FI] Finland ..... 904458

[51] Int. Cl.[5] ..... B21D 1/12

[52] U.S. Cl. ..... 72/457; 72/705

[58] Field of Search ..... 72/446, 457, 705

[56] References Cited

U.S. PATENT DOCUMENTS 4,824,303 4/1989 Dinger ..... 411/79

5,095,729 3/1992 Bundy ..... 72/705

FOREIGN PATENT DOCUMENTS 2145992 3/1973 Fed. Rep. of Germany .

2732048 1/1978 Fed. Rep. of Germany .

2834380 2/1980 Fed. Rep. of Germany .

1580440 9/1969 France .

2142868 2/1973 France .

*Primary Examiner*—Lowell A. Larson

*Attorney, Agent, or Firm*—Steinberg & Raskin

[57] ABSTRACT

The invention relates to a straightening device for a car body comprising a straightening table and therein sill fasteners or the like, from which the vehicle can be fixed to the straightening table. The straightening table can be lifted by means of a lifting device into a desired repair position. The joint between the straightening unit and the straightening table is realized by leading a beam connected to the straightening unit inside the beam of the straightening table. The equipment comprises in connection with the straightening unit such a beam structure that at least the second beam section can be moved relative to the first beam section, whereby said sections comprise a surface diagonal relative to the center axis of the beam structure. The equipment comprises a power unit by means of which an upper surface of the movable beam is brought into contact with an inner surface of the beam structure of the straightening table, whereby the upper surface of the beam structure aligns the straightening unit in the same horizontal direction as the straightening table.

12 Claims, 6 Drawing Sheets

STRAIGHTENING DEVICE FOR A CAR BODY

BACKGROUND OF THE INVENTION

The invention relates to a straightening device for a car body.

Straightening devices for a car body are known in prior art, in which a vehicle is driven onto driving plates and in which the vehicle is fixed to a straightening table from so-called sill fasteners. In this way, the vehicle can be firmly fixed to a working stand, by means of which the vehicle can be lifted to the desired height and repair position. Separate straightening units and straightening heads can be mounted on the straightening table, and their joining to the beams of the straightening table has in the solutions of prior art been performed by leading a beam of a rectangular cross-section inside a beam structure of the straightening table, which beam structure has a corresponding form but dimensions deviating therefrom, whereby a telescopic structure is obtained. This telescopically joined structure is locked by leading a bolt both through an outer beam structure and a beam structure located more inside relative thereto. Since the innermost and the outermost beam must have a clearance relative to each other, the joint becomes flexible and it does not offer the best possibilities of performing a demanding and dimensionally accurate straightening work.

OBJECTS AND SUMMARY OF THE INVENTION

The object of the invention is therefore to find an improvement on the joining problem, and it has been realized in the invention that it is advantageous to form the telescopic joint into a rigid form meeting the straightness requirements by forming a wedge coupling between an inner beam section and a beam section arranged more outside relative thereto.

The inventive straightening device for a car body is mainly characterized in that the equipment comprises a straightening unit joined to a straightening table, to its beam, which unit comprises a tool connected thereto or connectable thereto, by means of which a force can be concentrated on the object to be straightened, whereby the joint between the above-mentioned straightening unit and the straightening table is realized by leading a beam connected to the straightening unit inside the beam of the straightening table, and that the equipment comprises in connection with the straightening unit such a beam structure that at least the second beam section can be moved relative to the first beam section, whereby said sections comprise a surface diagonal relative to the center axis of the beam structure, and that the equipment comprises a power unit, by means of which the upper surface of the movable beam is brought into contact with the inner surface of the beam structure of the straightening table, whereby the upper surface of the beam structure aligns the straightening unit in the same horizontal direction as the straightening table and whereby the beam is by means of the power unit wedged relative to the beam section cooperative relative thereto, when the surfaces of the beam sections, which surfaces are cooperative relative to each other and diagonal relative to the center axis, are pressed against each other and kept together, as the actuator ensures a friction joint.

BRIEF DESCRIPTION OF THE DRAWINGS

The invention is next described with reference to certain preferred embodiments of the invention shown in the figures of the accompanying drawings, to which the invention is not intended solely to be limited.

DETAILED DESCRIPTION OF THE INVENTION

Figure 1:
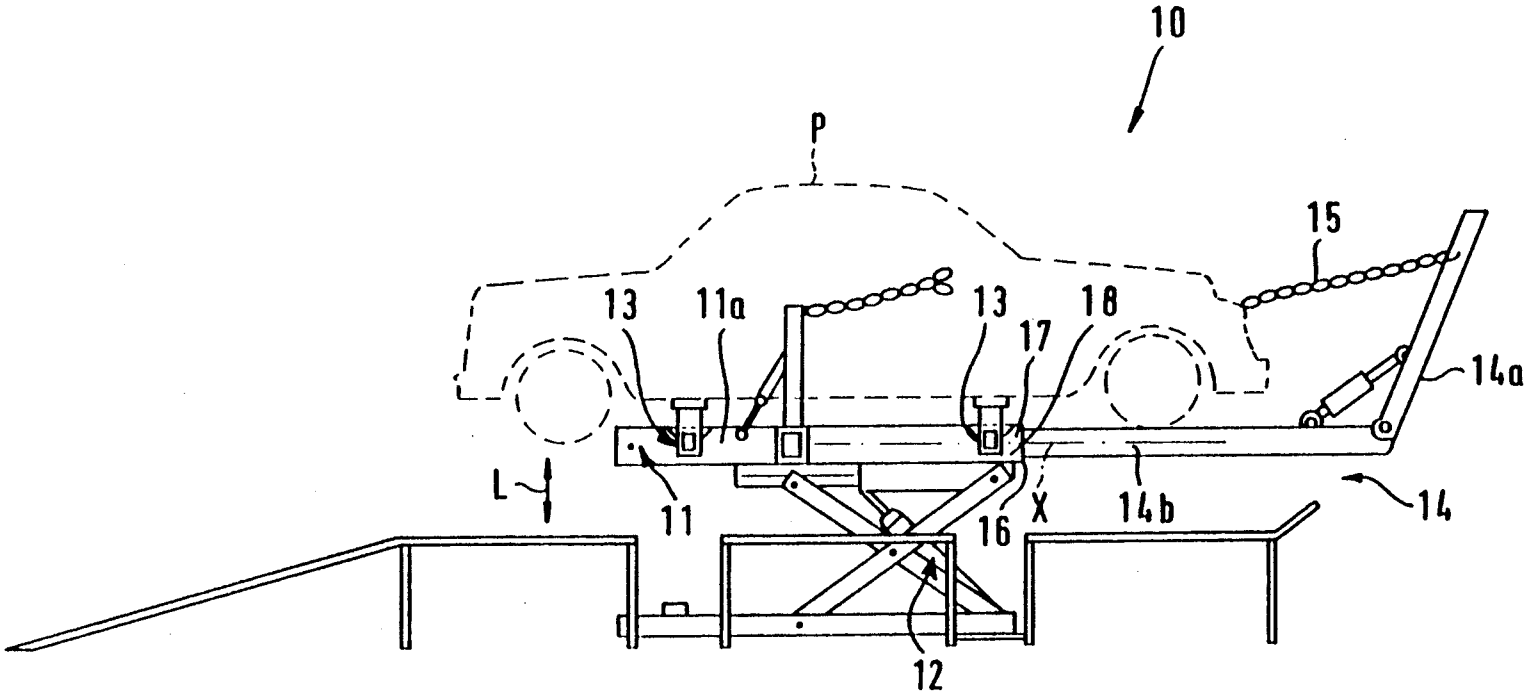
FIG. 1 shows as a side view a straightening device for a car body, and also a straightening unit joined to the straightening table of the straightening device, the fixing of which unit is realized in the inventive manner.

FIG. 1 shows a straightening device 10 for a car body according to the invention comprising a straightening table 11 and therein sill fasteners 13, to which the car can be fixed. By means of a lifting device 12, the vehicle P can be lifted above the straightening table 11 to the desired repair height. According to the figure, a straightening unit 14 is joined to the straightening table 11 and it comprises tools 15, e.g. drawing chains. The tool 15 on a straightening arm **14*a* of the straightening unit 14 can be turned by means of an actuator 14*b* such that the tool 15** concentrates a force to the object to be straightened in the vehicle.

Figure 2A:
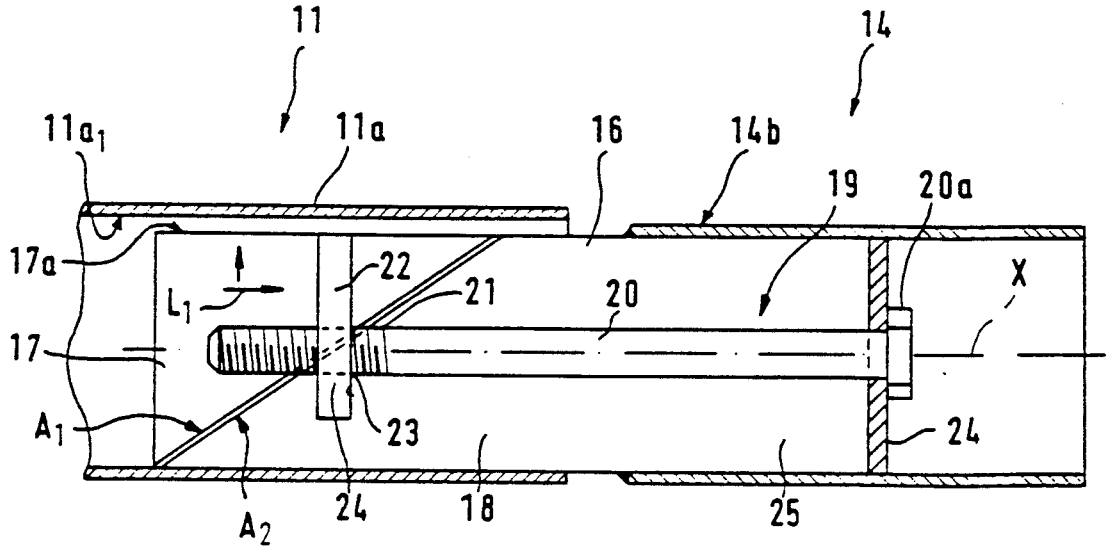
FIG. 2A shows the joint structure of FIG. 1 as a side and cross-sectional view.

According to FIG. 2A, the straightening unit 14 comprises on a straightening arm **14*c* an extension beam 16, which can be transferred inside a beam structure 11*a* of the straightening table 11. The beam 16 comprises a first beam section 17, which can be moved relative to a second beam section 18 with an actuator 19. A surface $A_1$ of the beam section diagonal relative to the center axis X of the beam is in the same manner diagonal as a surface $A_2$ of the beam 18, and when the beam section 17 is thus moved with the actuator 19, e.g. a screw 20, relative to the beam section 18 in the direction of an arrow $L_1$, the beam section 17 is lifted into a position, in which an upper surface 17*a* of the beam section 17 comes into contact with an inner surface $\mathbf{11}a_1$ of the beam 11*a*** of the straightening table.

According to the figure, the actuator 19 is a screw 20, which comprises at its end threads 21, which connect to threads 24 of an opening 23 of a cross-plate 22 of the movable wedge piece 17. In the straightening occurrence, a head part **20*a* of the screw 20 presses against a cross-plate 24. A through opening 25 of the cross-plate 24 is so large relative to the perimeter of the screw 20 that as the section 17 moves relative to the section 18, a change in the height position of said parts becomes possible, and at the same time, the screw 20 can turn relative to the center axis X. Thus, the upper surface 17*a* of the wedge piece 17 can be brought into contact with the inner surface $11a_1$ of the beam 11***a* of the straightening table by turning the screw.

Figure 2B:
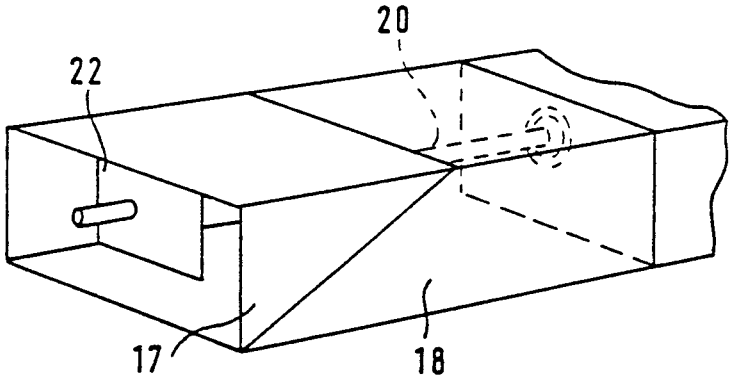
FIG. 2B illustrates the joining solution of FIG. 2A.

FIG. 2B illustrates the joint structure of FIG. 2A between the straightening unit and the straightening table 11. By means of the joint structure, the part to be joined to the straightening table can be brought into an exact desired position relative to the straightening table. The beam to be joined can be brought in the same horizontal direction as the straightening table.

Figure 2C:
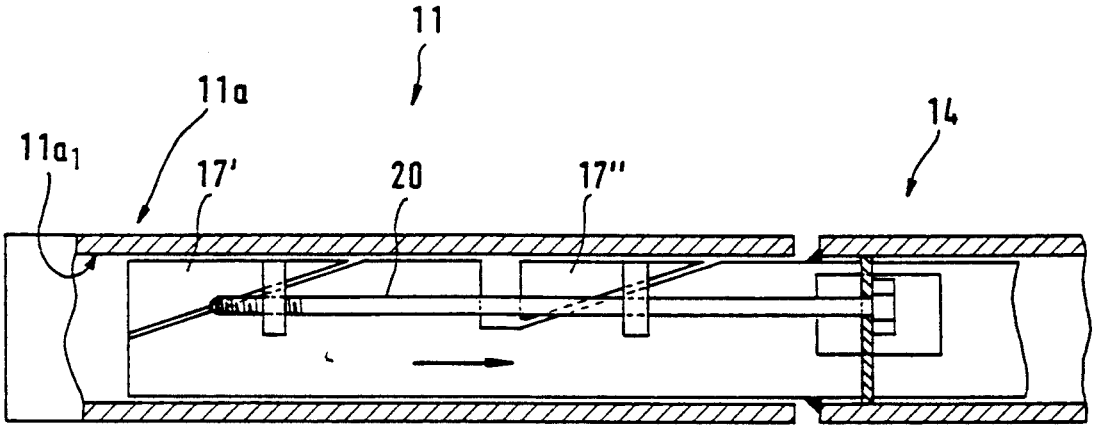
FIG. 2C shows the joint structure provided with two wedge pieces.

FIG. 2C shows an embodiment, in which two wedge pieces 17' and 17'' are moved with the same screw 20. Otherwise, the construction accurately corresponds to the constructions of FIG. 2A and 2B. By turning the screw device 20, the upper surfaces of the movable wedge pieces 17' and 17'' are brought simultaneously into contact with the inner surface $11a_1$ of the beam 11*a* of the straightening table 11.

Figure 3:
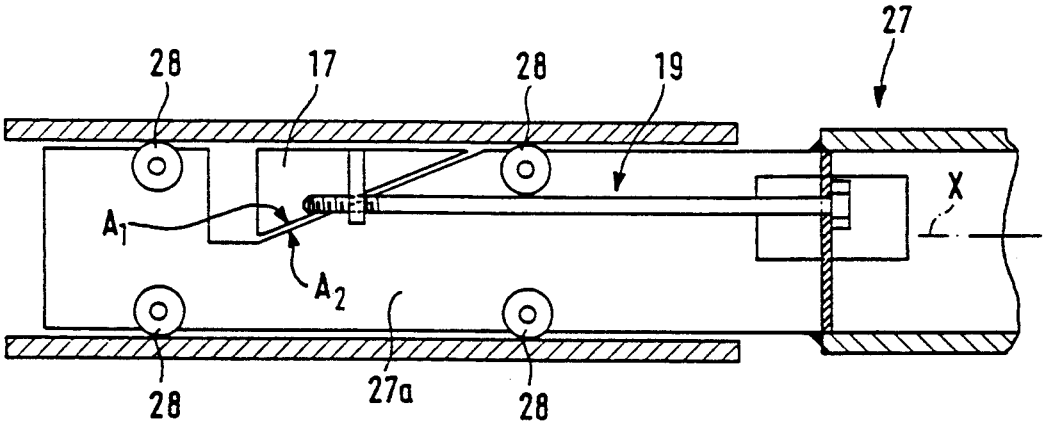
FIG. 3 shows another embodiment of the inventive joint structure provided with rollers.

FIG. 3 shows an embodiment corresponding to FIG. 2 except that an extension 27 to be joined to the straightening table 11, to its beam 11*a*, comprises at its end beam section 27*a* rollers 28, which guide the beam 27 relative to the beam 11*a*. In this way, the beam 27 can be aligned, guided by the rollers 28, into an accurate desired position relative to the beam 11*a* and locked in any position relative to said beam by means of the inventive arrangement. The wedge piece 17 can be moved against the counter wedge piece 18, when the surfaces $A_1$ and $A_2$ of the wedge pieces are in the same inclination angle as the center axis X of the beam. In the embodiments of FIGS. 2A-3, the actuator 19 can be a screw device, or the actuator 19 can be e.g. a double-acting pneumatic or hydraulic cylinder. The actuator 19 can also be e.g. a bar, the movement of which in the direction of the center axis X is achieved by an eccentric mechanism or by using e.g. gear wheels.

Figure 4:
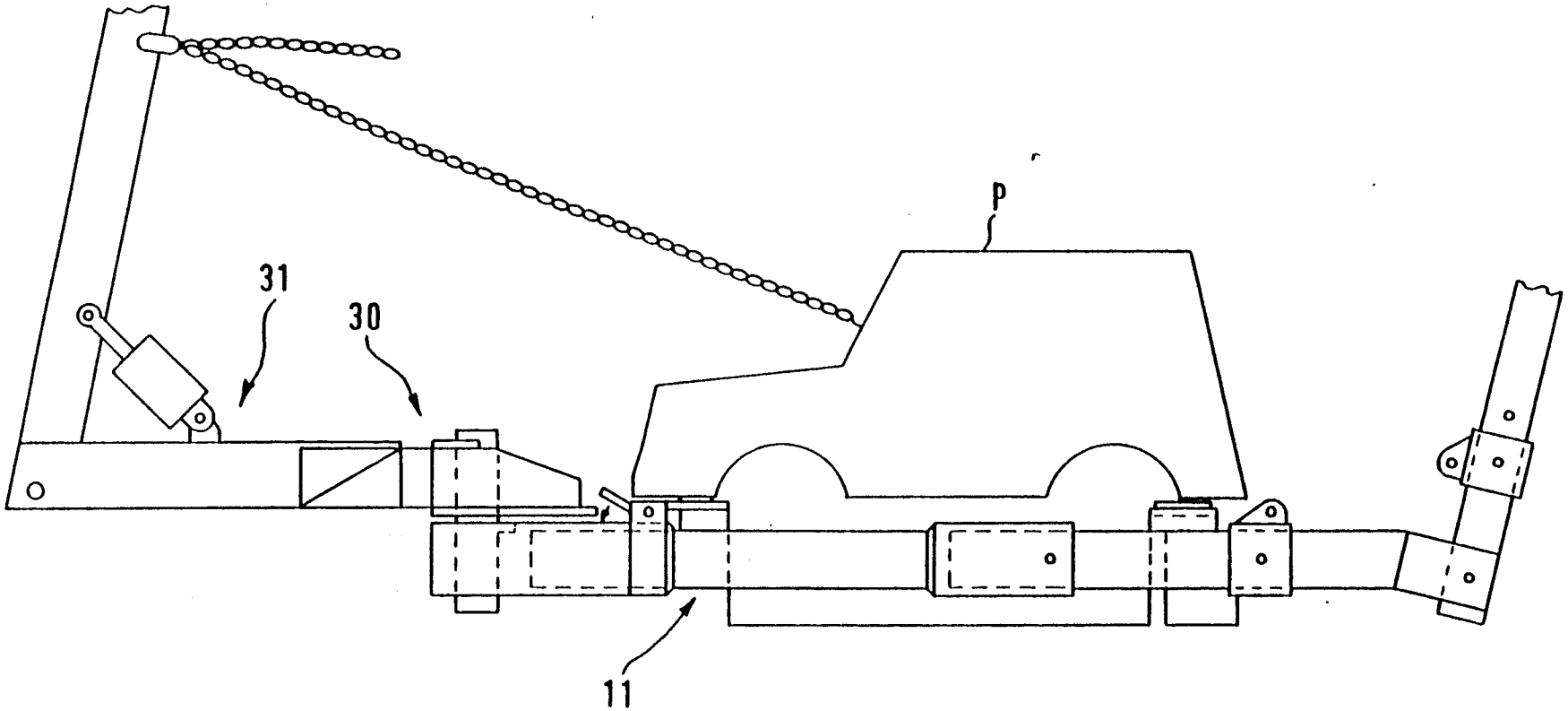
FIG. 4 shows the use of the inventive joint structure, when a straightening head is joined to a separate straightening unit of the straightening table.

FIG. 4 shows a straightening unit 30 of the straightening table 11 joined to the straightening table 11, to which unit is joined by means of the inventive wedge structure a straightening head 31.

Figure 5A:
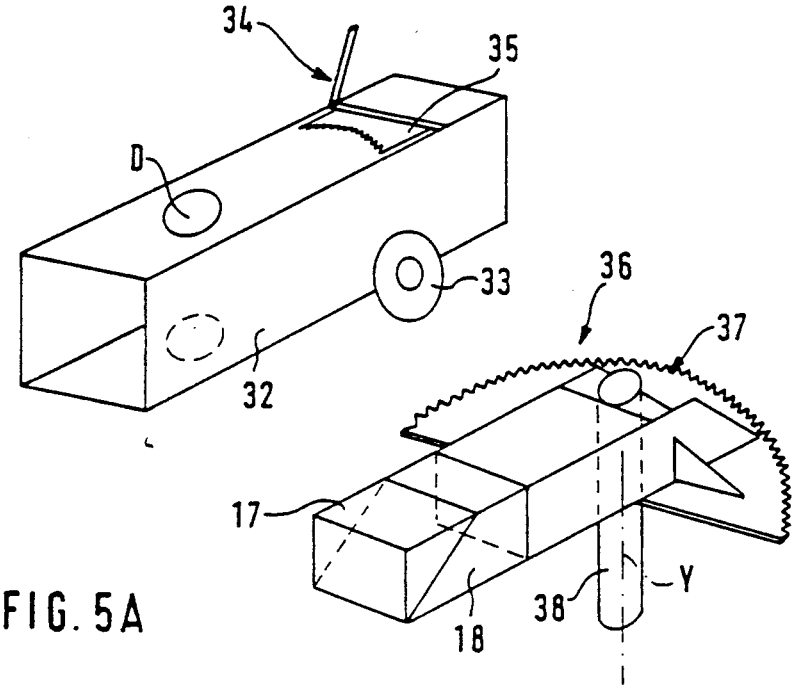
FIG. 5A shows the straightening unit shown in the device solution of FIG. 4 before the parts of the straightening unit are joined together.

FIG. 5A shows axonometrically the straightening unit 30 of FIG. 4, when the parts functional relative to each other are separated. The straightening unit comprises a bed frame 32 and therein wheels 33, on which the frame can be transferred to the connection of the straightening table 11. The bed frame 32 further comprises a locking device 34, whose toothing 35 can be brought into a countertoothing 37 of the turnable frame part 36. The rotatable frame part 36 can be turned around a geometric axis, as a shaft 38 rotates in a shaft opening D of the bed frame 32.

Figure 5B:
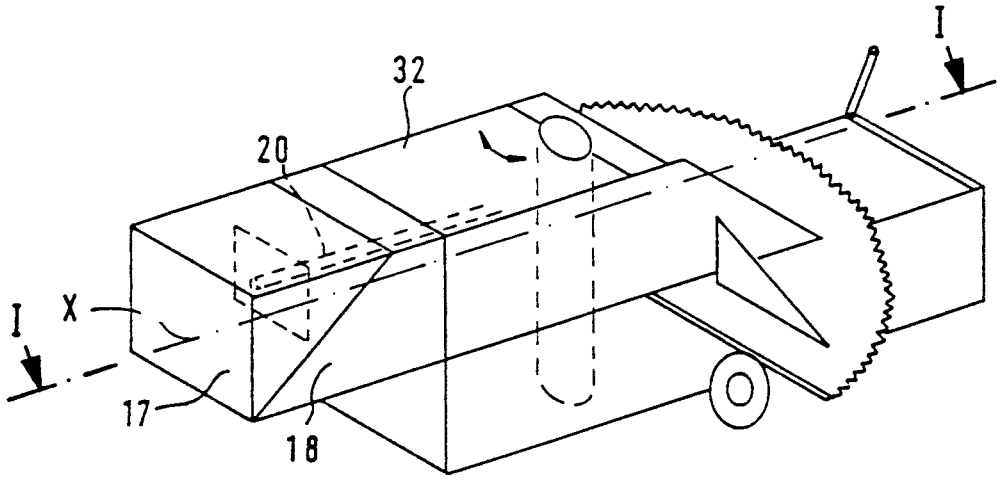
FIG. 5B shows the device solution of FIG. 5A when assembled.

FIG. 5B shows the separated parts of FIG. 5A when assembled. The rotatable frame part 36 can be turned into the desired straightening position and locked into the desired position, as the locking device 34 and the toothing 35 can be brought into the countertoothing 38, turnable by 180°, of the rotatable frame part, on the countertoothing plate 38. According to the figure, the rotatable frame part 36 comprises the movable wedge piece 17 and the wedge piece 18, which is in a fixed position relative thereto, the surfaces $A_1$ and $A_2$ of which pieces sliding relative to each other are diagonal with respect to the center axis of the beam formed by the above-mentioned parts. In the tightening occurrence, the part 17 can thus be lifted onto the beam section 31 to be joined thereto.

Figure 5C:
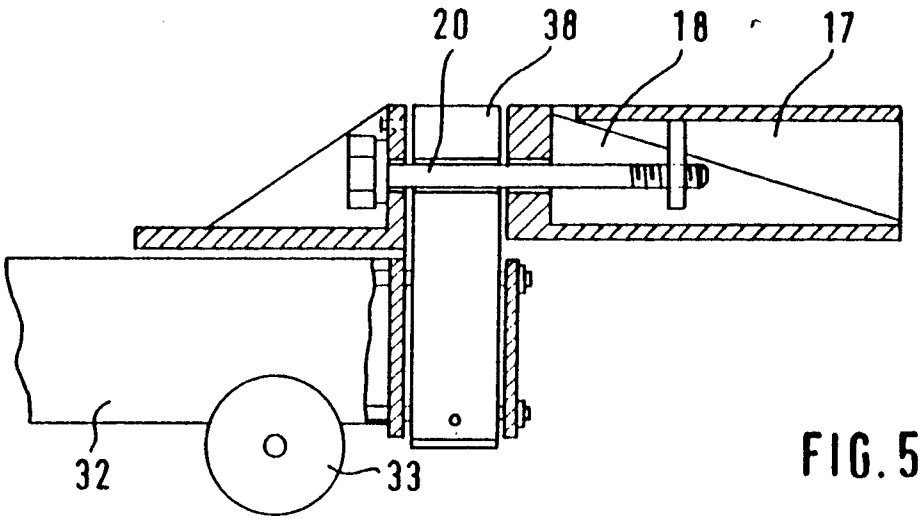
FIG. 5C shows a section I—I of FIG. 5B.

FIG. 5C shows the device solution of FIG. 5B as a section I—I of FIG. 5B. The screw 20 is led through the shaft 38.

I claim:

1. A straightening device for a car body comprising:

a straightening table having a beam and sill fasteners for fixing a vehicle to said straightening table, lifting means for lifting said straightening table into a desired position, a straightening unit comprising concentrating means for concentrating a force on an object to be straightened, and an extension beam having a first beam section and a second beam section, said extension beam being displaceable within said beam of said straightening table such that said straightening unit contacts said beam of straightening table, said second beam section being movable in relation to said first beam section, said first and second beam sections having corresponding surfaces in a diagonal relationship to a center axis of said extension beam, and displacement means for displacing an upper surface of said second beam section into contact with an inner surface of said beam of said straightening table such that said upper surface of said second beam section aligns said straightening unit in the same direction as said straightening table.

2. The device of claim 1, wherein said displacement means comprise an actuator structured and arranged to ensure a friction joint between said first beam section and said second beam section.

3. The device of claim 2, further comprising a cross plate arranged in said straightening unit, said second beam section having threads arranged in an interior portion, said actuator comprising a screw having a first end in a threaded engagement with said threads in said second beam section and a second end supported in said cross plate, said second beam section being moved into contact in a wedge-like manner with said inner surface of said beam of said straightening table upon rotation of said screw.

4. The device of claim 2, wherein said actuator is a cylinder device.

5. The device of claim 2, wherein said actuator is an eccentric mechanism.

6. The device of claim 2, further comprising a bed frame and a rotatable frame part having a shaft attached thereto, said bed frame having an opening in which said shaft is arranged to rotate, said actuator comprising a screw arranged to pass through said shaft, whereby said rotatable frame part is brought into different angle positions relative to said bed frame via a rotation of said shaft, said bed frame further comprising a locking device to lock said rotatable frame part to said bed frame.

7. The device of claim 6, further comprising a toothing plate arranged on said rotatable frame part, said locking device comprises a toothing arranged on said bed frame such that said toothing is lifted and lowered into and out of engagement with a corresponding toothing arranged on said toothing plate.

8. The device of claim 1, wherein said displacement means comprise a screw and said second beam section comprises a hollow girder having a rectangular cross-section or a square cross-section and a plate having a threaded opening arranged therein for passing said screw therethrough.

9. The device of claim 1, further comprising a cross-plate arranged in said extension beam, said displacement means comprise a screw, said cross-plate having an opening through which said screw is passed such that a head of said screw is pressed against said cross-plate upon rotation of said screw to cause said second beam section to contact said inner surface of said straightening table.

10. The device of claim 1, wherein said second beam section comprises at least two wedge-shaped pieces movable by means of said displacement means such that upper surfaces of said at least two wedge shaped pieces simultaneously contact said inner surface of said straightening table.

11. The device of claim 1, further comprising a plurality of rollers arranged in said beam of said straightening table, said first beam section being movable by means of said plurality of rollers in relation to said beam of said straightening table into a desired longitudinal position and being locked in a desired position in relation to said beam of said straightening table.

12. The device of claim 1, wherein said concentrating means comprise drawing chains.

* * * * *